United States Patent [19]

Carlin

[11] 4,181,586

[45] * Jan. 1, 1980

[54] CATHODE ELECTROCATALYST

[75] Inventor: William W. Carlin, Portland, Tex.

[73] Assignee: PPG Industries, Inc., Pittsburgh, Pa.

[ * ] Notice: The portion of the term of this patent subsequent to Mar. 1, 1994, has been disclaimed.

[21] Appl. No.: 916,637

[22] Filed: Jun. 19, 1978

[51] Int. Cl.[2] ..... C25B 1/46; C25B 11/04

[52] U.S. Cl. ..... 204/98; 204/290 R

[58] Field of Search ..... 204/290 R, 290 F, 98

[56] References Cited

U.S. PATENT DOCUMENTS 4,010,085 3/1977 Carlin ..... 204/128

*Primary Examiner*—F. C. Edmundson

*Attorney, Agent, or Firm*—Richard M. Goldman

[57] ABSTRACT

Disclosed is an electrode having a substrate with an electrically active surface film. The film has a relatively imporous, dense portion in contact with the substrate and containing cobalt, tungsten, and phosphorous, and a less dense, more porous containing oxycompounds of cobalt. Also disclosed is a method of preparing the electrode by electroless deposition of cobalt, tungsten, and phosphorous onto a metallic substrate and heating of the substrate in the presence of oxygen to a temperature and for a time sufficient to form filament-like cobalt oxycompound elements extending outwardly from the surface of the film.

14 Claims, 3 Drawing Figures

CATHODE ELECTROCATALYST

DESCRIPTION OF THE INVENTION

Chlorine and caustic soda are commercially produced by the electrolysis of alkali metal chlorides, e.g., sodium chloride and potassium chloride, in an electrolytic cell having an anolyte compartment separated from a catholyte compartment by a separator. Brine is fed to the anolyte compartment, and chlorine is evolved at the anode according to the reaction:

$$2Cl^- \rightarrow Cl_2 + 2e^-.$$

The alkali metal ion, either potassium ion or sodium ion, passes through the separator, which may be either an electrolyte permeable asbestos diaphragm, an electrolyte permeable microporous synthetic diaphragm, or an electrolyte impermeable, cation permeable, synthetic permionic membrane. In the catholyte compartment, the overall reaction is:

$$2H_2O + 2e^- \rightarrow H_2 + 2OH^-.$$

The cathode reaction is reported to be a two-step reaction, the first step being:

$$H_2O + e^- \rightarrow H_{ads} + OH^-$$

by which the monatomic hydrogen is adsorbed onto the surface of the cathode. In basic media, the adsorbed hydrogen is reported to be desorbed according to one of the two reactions:

$$2H_{ads} \rightarrow H_2,$$

or $$H_{ads} + H_2O + e^- \rightarrow H_2 + OH^-.$$

The hydrogen desorption step is reported to be the hydrogen overvoltage determining step. That is, it is the rate controlling step and its activation energy corresponds to the cathodic hydrogen overvoltage. The hydrogen evolution potential for the overall cathode reaction is on the order of about 1.4 to 1.5 volts versus a saturated calomel electrode (SCE) on iron in basic media. Iron, as used herein to characterize the cathodes, includes iron and iron alloys such as low carbon steels, stainless steel, alloys of iron with manganese, phosphorous, cobalt, nickel, molybdenum, chromium, vanadium, and the like.

According to the method disclosed herein, it has been found that the hydrogen overvoltage may be reduced, for example, by from about 0.2 volt to about 0.3 volt by using a cathode having an annealed surface of tungsten, cobalt, and phosphorous, where the cobalt is present as outwardly and upwardly extending acicular filaments rich in oxycompounds of cobalt.

THE FIGURES

The Figures are 10,000× scanning electron microscope views of the surfaces of electrodes of this invention at two stages of formation and, for comparison, an electrode annealed at a lower temperature.

DETAILED DESCRIPTION OF THE INVENTION

In the electrolysis of aqueous alkali metal chlorides, an electrical potential is imposed across an anode and a cathode of an electrolytic cell causing an electrical current to pass from the anode to a cathode of the cell, evolving chlorine at the anode and hydrogen at the cathode. According to the disclosed method, the cathode has a substrate with an electrically active film thereon. The film has a more dense, less porous portion in contact with the cathode substrate and an outer, less dense, more porous portion. The outer, less dense, more porous portion has a higher cobalt content than the inner, more dense, less porous portion of the film. The cobalt in the outer portion is present primarily as oxycompounds. The outer portion contains outwardly and upwardly extending acicular filaments rich in oxycompounds of cobalt. It is this outer, less dense, more porous portion that is in contact with the electrolyte.

Further disclosed is an electrolytic cell having an anode, a cathode, and an external means for imposing an electrical potential between the anode and the cathode. The electrolytic cell is characterized in that the cathode has a substrate with film thereon. The film has an inner, less porous, more dense portion in contact with the substrate and an outer, more porous, less dense portion having outwardly and upwardly extending acicular filaments rich in oxycompounds of cobalt.

Additionally, there is disclosed a method of providing a low cathodic hydrogen overvoltage cathode by electrolessly depositing a cobalt, tungsten, and phosphorous film onto a substrate and annealing at a temperature sufficient to cause the conversion of the electroless deposited cobalt to cobalt oxide in the form of filaments, threads, or acicular elements extending upwardly and outwardly from the electroless deposited film.

The electrode herein contemplated has a substrate that is macroscopically permeable to electrolyte but microscopically impermeable thereto. That is, the substrate is permeable to bulk flow of electrolyte therethrough between individual elements thereof, such as between individual rods or wires or perforations, but not to the flow of electrolyte into and through the individual elements thereof. The cathode itself is normally a foraminous member such as a perforated plate, perforated sheet, wire mesh, wire screen, expanded metal mesh, rods, or the like. However, the cathode may also be an impermeable plate or sheet, as when it is spaced from the separator.

The substrate is fabricated of any material that is substantially resistant to aqueous alkaline media under cathodic conditions. Suitable materials include iron, steel, stainless steel, alloys of iron with cobalt, nickel, manganese, vanadium, carbon and the like and copper. Whenever iron cathodes are referred to herein, it will be understood that cathodes fabricated of the above alloys are encompassed thereby.

Figure 1:
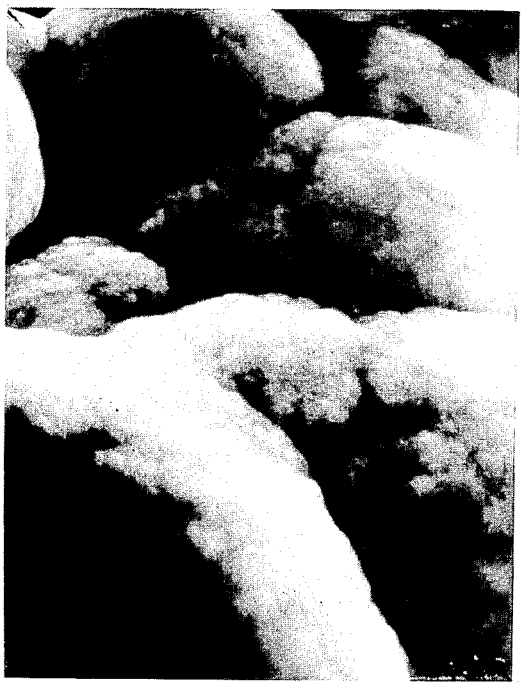
FIG. 1 shows the surface of an electrode where the cobalt, tungsten, and phosphorous have been deposited but no heating has taken place.
Figure 2:
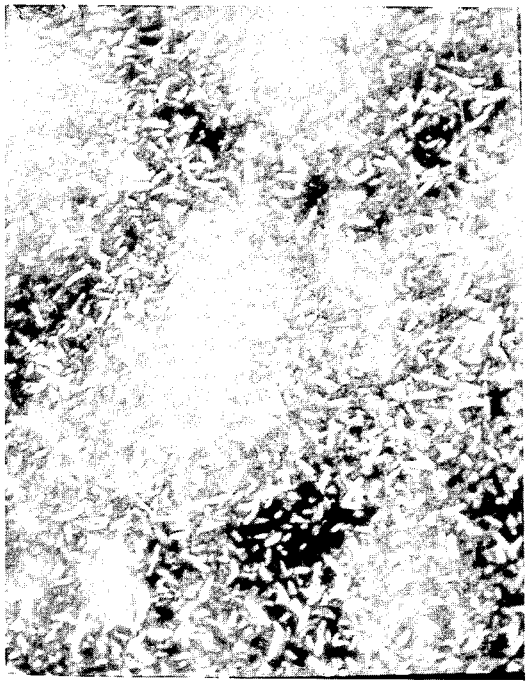
FIG. 2 is a comparison showing the surface of an electrode, electrolessly plated with cobalt, tungsten, and phosphorous, that has been heated to 350° C. for 48 hours.
Figure 3:
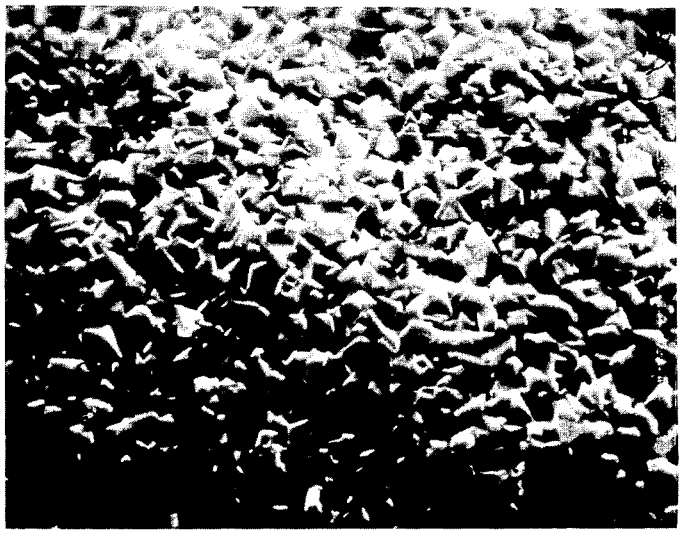
FIG. 3 shows the surface of an electrode, electrolessly plated with cobalt, tungsten, and phosphorous, that has been heated to 450° C. for 48 hours to form acicular filaments extending outwardly from the substrate.

The substrate has a cobalt-rich film thereon. The electrode shown in FIG. 3 has a more dense, less porous portion bearing upon the substrate and enriched in tungsten and depleted in cobalt relative to the original composition of the unannealed electroless plate. Atop the more dense, less porous inner portion is a less dense, more porous outer portion enriched in cobalt relative to the original electroless plate. This less dense, more porous, cobalt enriched outer portion of the film is characterized by outwardly and upwardly extending acicular filaments of elements of oxycompounds of cobalt. The structure of the less dense, more porous outer portion is shown in FIG. 3. The cobalt is believed to be present in the acicular elements of the outer portion as $Co_2O_3$ and $Co_3O_4$.

The less dense, more porous outer portion is characterized by an electron spectroscopy analysis scan showing the substantial absence of tungsten within 3700 Angstroms of the exposed surface thereof. The acicular elements themselves have been determined, by electron spectroscopy, to consist essentially of oxycompounds of cobalt, being $Co_2O_3$ and $Co_3O_4$ and predominantly $Co_2O_3$. It is believed that these acicular filaments are formed by the migration of cobalt out of the more dense portion during annealing in the presence of oxygen.

The coating on the cathode is provided by tungsten, cobalt, and phosphorous. The amount of tungsten is typically from about 10 weight percent to about 20 weight percent of the entire coating and preferably from about 12 to about 16 weight percent thereof. The amount of phosphorous is from about 2 weight percent to about 6 weight percent of the total coating and preferably from about 3 weight percent to about 5 weight percent thereof. The cobalt is the balance of the coating. The coating on the cathode may be provided by standard electroless deposition procedures, for example, as described in commonly assigned U.S. Pat. No. 4,010,085 to W. W. Carlin for CATHODE ELECTROCATALYST and in commonly assigned U.S. Pat. No. 4,086,189 to A. Martinsons and M. Crenshaw for CATHODE ELECTROCATALYST.

The electroless deposition coating solution is an alkaline solution containing a tungsten salt, a cobalt salt, a complexing agent, a reducing agent, and a buffering agent. Preferred cobalt salts are $CoCl_2 \cdot 6H_2O$ and $CoSO_4 \cdot 7H_2O$. The preferred tungsten salts are the alkali metal tungstates. The reducing agent is selected from the class of alkali metal hypophosphites, especially sodium hypophosphite and potassium hypophosphite. The complexing agent is selected from the group consisting of carboxylic acids and their alkali metal salts. Especially preferred are polycarboxylic acids and their alkali metal salts. Useful polycarboxylic acids include malonic acid, succinic acid, glutaric acid, adipic acid, pimelic acid, tartronic acid, malic acid, tricarballylic acid, and citric acid. Citric acid is particularly preferred because of low cost, high functionality, and low weight. Other useful complexing agents are hydroxy acetic acid, acetic acid, lactic acid, propionic acid, and their alkali metal salts. One particularly preferred complexing agent is sodium citrate. The pH of the solution is buffered. Borate buffers are preferred. One particularly desirable buffer is sodium tetraborate. The pH of the electroless plating solution is maintained alkaline, e.g., from about 7 to 10, and preferably from about 8.0 to 8.7. The time for electroless deposition is generally long enough to provide an electroless deposited coating of about 2 to about 12 microns in thickness. This is generally from about 4 to about 24 hours.

The concentration of materials in the bath is maintained high enough to provide a satisfactory rate of deposition but low enough to provide the desired concentration of tungsten in the deposit. This is because the overall rate of deposition increases with increasing concentration of the components in the bath but, at increasingly high concentrations, for example, above about 195 grams per liter total salts in the electroless deposition bath, there is a slight decrease in the amount of tungsten deposited.

While the temperature of the bath is not critical, it is generally between room temperature, 20° C., and the reflux temperature of the electroless deposition bath. The ratios of the deposited metals are relatively independent of temperature. However, the deposition rate is a strong function of temperature.

The pH is alkaline, in the range of from about pH 7 to pH 10, generally from pH 8.0 to 8.7, and preferably from about pH 8.2 to pH 8.6, as described above. The selection of an appropriate pH requires balancing the tungsten deposition rate against total deposition rate. The overall deposition rate is faster at weakly alkaline pH's, i.e., from about 7 to about 8, and slower at more strongly alkaline pH's, i.e., from about 9 to about 10. The tungsten deposition is highest in the weakly alkaline pH range, i.e., pH 7 to pH 8, and lowest in the strongly alkaline range of pH 9 to pH 10. Generally, a pH of from about 8.2 to about 8.6 is preferred with a pH of from about 8.35 to about 8.50 being particularly desirable.

The substrate to be electrolessly coated is placed in the electroless coating composition, the pH of the composition is adjusted until satisfactory hydrogen evolution is observed for the desired ratios of tungsten, cobalt, and phosphorous, e.g., a pH of from about 8.0 to about 8.7, and deposition is continued for about 4 to about 24 hours whereby to obtain a coating of satisfactory thickness, i.e., from about 2 micron to about 12 microns. Thinner coatings may be used with satisfactory results although there may be less development of the cobalt oxide. Thicker coating compositions may be used although there may be an increased tendency to lose the coating during service.

After electroless deposition of the cobalt, tungsten, phosphorous containing film, the substrate is heated in the presence of oxygen. Heating in the presence of oxygen oxidizes the cobalt, causing hair-like acicular filaments of cobalt oxycompounds to grow upwardly from the less porous, more dense portion of the film and form a more porous, less dense portion while oxidizing the cobalt through the +2 and mixed +2 and +3 oxides, e.g., $Co_3O_4$ and CoO to form $Co_2O_3$.

The heating is carried out in the presence of an oxidizing atmosphere, i.e., an oxygen-containing atmosphere. While the oxygen-containing atmosphere may be atmospheric air at atmospheric pressure, it is also to be understood that an oxygen atmosphere may be used, or air at a pressure elevated with respect to atmospheric, i.e., at a pressure greater than one atmosphere, may be used.

The temperature of annealing is a function of the partial pressure of oxygen. The temperature should be high enough to oxidize the cobalt. Preferably, for air at atmospheric pressure, the temperature should be above 400° C. but less than 650° C. Temperatures below about 400° C. do not provide full oxidation of the cobalt while temperatures over about 650° C. result in a physically unstable coating.

The time of heating is a function of the temperature and partial pressure of oxygen. The time should be at least 24 hours for air at one atmosphere and a temperature of 450° C. Preferably, the time is from about 36 to about 72 hours. It has been found that while heating the electrolessly coated substrate in air at 400° C. for one hour is sufficient to form the acicular filaments extending upwardly from the more dense, less porous surface, the filaments do not contain a sufficiently catalytic form of the oxycompounds of cobalt, nor are the filaments formed by heating to 450° C. for one hour as long-lived as those formed by heating to 450° C. for 24 hours. However, even the oxycompound formed at 450° C. for 24 hours appears to be less catalytic than the oxycompound formed at 450° C. for 48 hours. It is believed that this is because the material heated for 48 hours contains predominantly one oxidation state, the trivalent oxidation state, $Co_2O_3$.

After electroless deposition, the electrolessly plated substrate is heated high enough and long enough for the cobalt to migrate to the surface and form the acicular filaments and oxidize and for the phosphorous to migrate to the less dense, more porous portion of the surface. Preferably, the electrolessly plated substrate is heated hot enough and long enough for the cobalt to oxidize to the +3 oxidation state.

The cathodes, prepared as described above, have a hydrogen overvoltage of from about 1.15 to about 1.26 volts versus a saturated calomel electrode (SCE) in alkaline media. Conventional iron cathodes have a hydrogen overvoltage of from about 1.4 to about 1.57 volts versus a saturated calomel electrode (SCE) under the same conditions. In this way, a voltage savings of from about 0.25 volt to about 0.31 volt is obtained when the current density is approximately 190 amperes per square foot.

The following examples are illustrative.

Example 1

An electrode having an annealled, electrolessly deposited coating of cobalt, tungsten, and phosphorous was prepared and utilized as a cathode in a chlor-alkali cell.

In preparing the cathode, a 5 inch by 7 inch by ⅛ inch (12.7 cm by 17.2 cm by 0.32 cm) mild steel perforated plate was sandblasted and then cleaned by dipping into a 1.1 normal solution of aqueous hydrochloric acid.

Thereafter, the plate was inserted in a bath containing:

cobaltous chloride ($CoCl_2 \cdot 6H_2O$)—4 grams
sodium hypophosphite ($NaH_2PO_2 \cdot H_2O$)—15 grams
sodium tungstate ($Na_2WO_4 \cdot 2H_2O$)—12 grams
sodium citrate ($Na_3C_6H_5O_7 \cdot 2H_2O$)—30 grams
sodium borate ($Na_2B_4O_7 \cdot 10H_2O$)—4 grams
water to make 24 liters of solution The bath was at a temperature of about 78° to 87° C. and a pH of 8.3 to 8.7. The perforated plate was placed in the bath for 6 hours and 20 minutes, rinsed in water, and dried in air for 16 hours. The perforated plate was then rinsed in 1.1 normal aqueous hydrochloric acid for 2 minutes, rinsed in water, and placed in a fresh electroless plating bath. The bath contained:

cobaltous chloride ($CoCl_2 \cdot 6H_2O$)—4 grams
sodium hypophosphite ($NaH_2PO_2 \cdot H_2O$)—15 grams
sodium tungstate ($Na_2WO_4 \cdot 2H_2O$)—12 grams
sodium citrate ($Na_3C_6H_5O_7 \cdot 2H_2O$)—30 grams
sodium borate ($Na_2B_4O_7 \cdot 10H_2O$)—4 grams
water to make 24 liters of solution The bath was at a temperature of 83° to 90° C. and a pH of 7.8 to 8.6. The perforated plate was placed in the bath for 4 hours and 40 minutes, rinsed in water, dried in air for 16 hours, inserted in 1.1 normal aqueous hydrochloric acid for 30 seconds, and rinsed in water.

Thereafter, 20 grams of cobaltous chloride ($CoCl_2 \cdot 6H_2O$) and 60 grams of sodium hypophosphite were added to the electroless plating bath. The perforated plate was inserted into the bath for 2 hours and 40 minutes with the bath maintained at 87° to 89° C. and a pH of 8.3 to 8.5.

The electrolessly plated perforated plate was then removed from the bath, rinsed in water, and heated to 450° C. for 48 hours in a resistance furnace that was open to the atmosphere.

The resulting cathode was then placed in a laboratory diaphragm cell having a 5 inch by 7 inch (12.7 cm by 17.2 cm) expanded metal mesh anode with an $RuO_2$—$TiO_2$ coating. The cathode was spaced ⅛ inch (3.2 mm) from the anode with a DuPont NAFION® 715 perfluorinated sulfonic acid polymer diaphragm therebetween.

Electrolysis was carried out at a current density of 190 amperes per square foot with a cell voltage of 2.8 to 3.2 volts for 353 days.

Example 2

An electrode having an annealled, electrolessly deposited coating of cobalt, tungsten, and phosphorous was prepared and utilized as a cathode in a chlor-alkali cell.

In preparing the cathode, a 5 inch by 7 inch by ⅛ inch (12.7 cm by 17.2 cm by 0.32 cm) mild steel screen was cleaned by dipping in 4 normal hydrochloric acid, anodized in 1 normal sulfuric acid at a current density of 5 amperes per square foot for 2 minutes, and then cleaned again by dipping into a 1.1 normal solution of aqueous hydrochloric acid.

Thereafter the plate was inserted in a bath containing:

cobaltous chloride ($CoCl_2 \cdot 6H_2O$)—4 grams
sodium hypophosphite ($NaH_2PO_2 \cdot H_2O$)—15 grams
sodium tungstate ($Na_2WO_4 \cdot 2H_2O$)—12 grams
sodium citrate ($Na_3C_6H_5O_7 \cdot 2H_2O$)—30 grams
sodium borate ($Na_2B_4O_7 \cdot 10H_2O$)—4 grams
water to make 24 liters of solution The bath was at a temperature of about 85° to 90° C. and a pH of 8.25 to 8.50. The steel screen was placed in the bath for 5 hours; rinsed in water, and dried in air for 16 hours. The perforated plate was then rinsed in 1.1 normal aqueous hydrochloric acid for 0.5 minutes, rinsed in water, and placed back into the electroless plating bath.

The steel mesh was placed back into the bath for 5 hours and 50 minutes with the bath maintained at 84° to 88° C. and a pH of 8.3 to 8.6.

The electrolessly plated steel mesh was then removed from the bath, rinsed in water, and heated to 450° C. for 48 hours in a resistance furnace that was open to the atmosphere.

The resulting cathode was then placed in a laboratory diaphragm cell having a 5 inch by 7 inch (12.7 cm by 17.2 cm) expanded metal mesh anode with an $RuO_2$-$TiO_2$ coating. The cathode was spaced ⅛ inch (3.2 mm) from the anode with a DuPont NAFION® 715 perfluorinated sulfonic acid polymer diaphragm therebetween.

Electrolysis was carried out at a current density of 190 amperes per square foot with a cell voltage of 2.9 to 3.1 volts and a cathode voltage of from 1.10 to 1.26 on the back surface of the cathode for 217 days.

Example 3

An electrode having an annealled, electrolessly deposited coating of cobalt, tungsten, and phosphorous was prepared and utilized as a cathode in a chlor-alkali cell.

In preparing the cathode, a 5 inch by 7 inch by 1/16 inch (12.7 cm by 17.2 cm by 0.16 cm) mild steel mesh screen was cleaned by anodizing.

Thereafter, the plate was inserted in a bath containing:

cobaltous chloride ($CoCl_2 \cdot 6H_2O$)—4 grams
sodium hypophosphite ($NaH_2PO_2 \cdot H_2O$)—15 grams
sodium tungstate ($Na_2WO_4 2H_2O$)—12 grams
sodium citrate ($Na_3C_6H_5O_7 \cdot 2H_2O$)—30 grams
sodium borate ($Na_2B_4O_7 \cdot 10H_2O$)—4 grams
water to make 24 liters of solution The bath was at a temperature of about 85° to 88° C. and a pH of 8.28 to 8.51. The mesh screen was placed in the bath for 6 hours and 30 minutes, rinsed in water, and dried in air for 16 hours. The mesh screen was then rinsed in 1.1 normal aqueous hydrochloric acid for 20 seconds, rinsed in water, and placed back into the electroless plating bath.

Thereafter, the mesh sheet was placed back into the bath for 3 hours with the bath maintained at 87° to 89° C. and a pH of 8.4 to 8.5.

The electrolessly plated mesh sheet was then removed from the bath, rinsed in water, and heated to 450° C. for 48 hours in a resistance furnace that was open to the atmosphere.

A slurry containing approximately 1.8 weight percent total solids, e.g., 90 weight percent crysotile asbestos, and 10 weight percent Allied Chemical Company HALAR® alternating chlorotrifluoroethylene-ethylene copolymer, basis total weight of solids, in a solution of 15 weight percent NaCl and 10 weight percent NaOH, was drawn through the cathode. This deposited approximately 0.35 pounds per square foot of asbestos and poly (chlorotrifluoroethylene-ethylene) on the cathode. The cathode was then slowly heated to 100° C., maintained thereat for 24 hours, heated to 236° C., and maintained thereat for 1 hour.

The resulting cathode having a deposited diaphragm was then placed in a laboratory diaphragm cell having a 5 inch by 7 inch (12.7 cm by 17.2 cm) expanded metal mesh, $RuO_2$—$TiO_2$ coated titanium anode. The cathode was spaced 0.25 inch (6.4 mm) from the anode.

Electrolysis was carried out at a current density of 190 amperes per square foot for 132 days.

While the invention has been described with respect to certain exemplifications and embodiments, the invention is not to be so limited, except as in the claims appended hereto.

I claim:

1. An electrode having a substrate with a film thereon comprising cobalt, tungsten, and phosphorous; said film being prepared by the method comprising depositing cobalt, tungsten, and phosphorous onto said substrate and thereafter heating said substrate to between 400° C. and 600° C. for at least about 24 hours whereby to oxidize cobalt to the +3 oxidation state; and said film having:

(a) a first portion in contact with said substrate; and
(b) a second portion atop said first portion, being more porous than said first portion, and having acicular filaments extending outwardly therefrom.

2. The electrode of claim 1 wherein said second portion has a higher cobalt oxycompound content than said first portion.

3. The electrode of claim 2 wherein said second portion is substantially free of tungsten, as determined by electron spectroscopy analysis, to a depth of at least 3700 Angstroms from the surface.

4. An electrode having a substrate with a film thereon, comprising cobalt, tungsten, and phosphorous; said film being prepared by the method comprising depositing cobalt, tungsten, and phosphorous onto said substrate and thereafter heating said substrate to between 400° C. and 600° C. for at least about 24 hours, said film having:

(a) a first portion in contact with said substrate; and
(b) a second portion atop said first portion, being more porous than said first portion, and having a higher cobalt content than said first portion, the cobalt in said second portion being present as an oxycompound in the +3 oxidation state.

5. The electrode of claim 4 wherein said second portion has acicular filaments extending outwardly therefrom.

6. The electrode of claim 5 wherein said acicular filaments consist essentially of cobalt oxycompounds.

7. The electrode of claim 4 wherein said second portion is substantially free of tungsten, as determined by electron spectroscopy analysis, to a depth of at least 3700 Angstroms from the surface.

8. A method of electrolyzing an alkali metal chloride brine comprising passing an electrical current from an anode to a cathode, said cathode having a substrate with a film comprising cobalt, tungsten, and phosphorous; said film being prepared by the method comprising depositing cobalt, tungsten, and phosphorous onto said substrate and thereafter heating said substrate to between 400° C. and 600° C. for at least about 24 hours whereby to oxidize cobalt to the +3 oxidation state, said film having:

(a) a first portion in contact with said substrate; and
(b) a second portion atop said first portion being more porous than said first portion and having acicular filaments extending outwardly therefrom.

9. The method of claim 8 wherein the second portion of the film has a higher cobalt oxycompound content than said first portion.

10. The method of claim 9 wherein the second portion of the film is substantially free of tungsten, as determined by electron spectroscopy analysis, to a depth of at least 3700 Angstroms from the service.

11. A method of electrolyzing an alkali metal chloride brine comprising passing an electrical current from an anode to a cathode, said cathode having a substrate with a film thereon, which film comprises cobalt, tungsten, and phosphorous; said film being prepared by the method comprising depositing cobalt, tungsten, and phosphorous onto said substrate and thereafter heating said substrate to between 400° C. and 600° C. for at least about 24 hours; said film having:

(a) a first portion in contact with said substrate; and
(b) a second portion atop said first portion being more porous than said first portion and having a higher cobalt content than said first portion, the cobalt in said second portion being present as an oxycompound in the +3 oxidation state.

12. The method of claim 11 wherein the second portion of the film has acicular filaments extending outwardly therefrom.

13. The method of claim 12 wherein said acicular filaments consist essentially of cobalt oxycompounds.

14. The method of claim 11 wherein the second portion of the film is substantially free of tungsten, as determined by electron spectroscopy analysis, to a depth of at least 3700 Angstroms from the surface.

* * * * *